United States Patent [19]

Nicolai

[11] Patent Number: 4,573,720

[45] Date of Patent: Mar. 4, 1986

[54] FAILSAFE SECURITY LOCK

[76] Inventor: J. Steven Nicolai, 8754 Oak Park Ave., Northridge, Calif. 91325

[21] Appl. No.: 528,457

[22] Filed: Sep. 1, 1983

[51] Int. Cl.[4] ..... E05C 13/10

[52] U.S. Cl. ..... 292/144

[58] Field of Search ..... 292/144, 201, 40, 33, 292/251.5; 70/276

[56] References Cited

U.S. PATENT DOCUMENTS

| | | | |
|---|---|---|---|
| 3,751,086 | 8/1973 | Geringer | 297/144 |
| 3,751,088 | 8/1973 | Schlage et al. | 292/201 |
| 4,021,065 | 5/1977 | Geringer | 292/144 |
| 4,439,808 | 3/1984 | Gillham | 292/144 X |
| 4,470,625 | 9/1984 | Walsh et al. | 292/201 |

FOREIGN PATENT DOCUMENTS

| | | | |
|---|---|---|---|
| 68980 | 3/1958 | France | 292/144 |

*Primary Examiner*—Richard E. Moore

*Attorney, Agent, or Firm*—Sanford Astor

[57] ABSTRACT

The failsafe security lock system of this invention utilizes a fire rated latch bolt, which is retracted by knobs, levers or exit devices from either side of the door. The failsafe security system comprises the use of the magnetic lock or similar device which is controlled from the inside of the door by a knob, lever or exit device. The magnetic lock is controlled by use of the magnetic switch mounted in the door jamb and an internal bar magnet in the lock mounted in the door. When the inside knob, lever or exit device is activated the latch bolt is retracted and the internal magnet is removed from the magnetic switch and power is cut off from the magnetic lock, unlocking the door. To open the door from the outside power has to be cut to the magnetic lock. This is accomplished by use of a key which would remove the internal magnet from the magnetic switch locking the door. The system is totally failsafe in that if the power is cut in any way, the magnetic lock will release and the door can be opened from either side. This system can be tied into existing fire alarm systems or to a central control panel.

15 Claims, 9 Drawing Figures

FAILSAFE SECURITY LOCK

BACKGROUND OF THE INVENTION

Security requires that a door be locked to the outside while being able to be opened by a knob, lever or exit device from the inside. Fire regulations, however, often require that in case of an emergency, the door can open from the outside with no special knowledge. Thus, there is a need to electrically control doors while allowing totally failsafe unlocking to assure life safety. All fire doors require that the door is latched and be able to be opened with no special knowledge. This is normally in direct conflict with security requirements.

OBJECTS OF THE INVENTION

It is an object of the present invention to provide a failsafe security lock.

It is a further object of the invention to provide an electrically controlled failsafe security latch which meets all existing fire regulations.

It is still a further object of this invention to provide a failsafe security lock which comprises a latch bolt to meet the requirements of a fire door, which does not use any mechanical locking device which could bind and fail to release as required by fire regulations and which can be centrally controlled so that the door can be opened from the central control station.

These and other objects of the invention will become more apparent with reference to the following detailed description taken in conjunction with the attached drawings in which.

DETAILED DESCRIPTION

Figure 1:
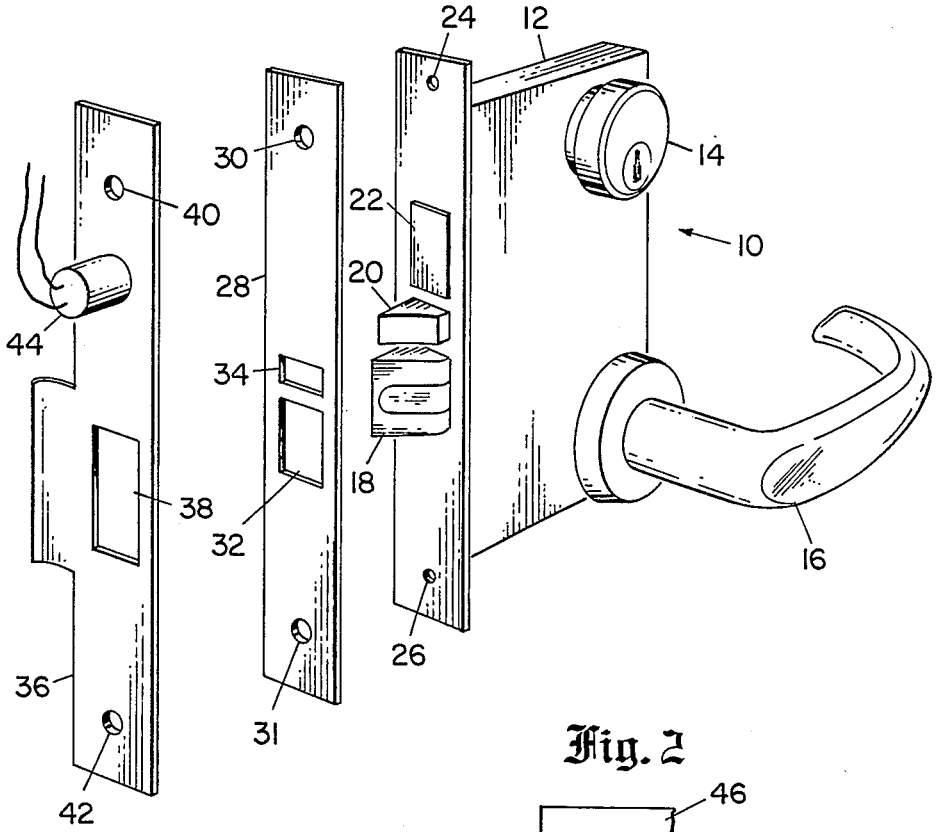
FIG. 1 is a perspective view of the device of the present invention.

Referring to FIG. 1 there is shown generally a door lock 10 of the present invention. The door lock 10 comprises a lock housing 12 having a cylinder 14 optional on either side depending upon whether one wants a key locking cylinder on the outside of the door, and a lever, knob or exit device 16. The lock 10 also comprises a latch bolt 18 and an auxiliary deed locking latch 20. The internal magnet assembly 22 is located at a position where one might normally find a dead bolt.

Holes 24 and 26 are provided for attachment to the face plate 28, with matching holes 30 and 31 for connection to the lock housing 12.

A hole 32 is provided for the latch bolt 18, and a hole 34 is provided for the auxiliary dead locking latch 20. On the jamb of the door there is placed the lock strike

36, which contains the latch bolt keeper 38 and holes 40 and 42 for attachment to the door jamb. A magnetic switch 44 is placed abutting the back of the lock strike 36 and opposite the internal magnet assembly 22.

Figure 2:
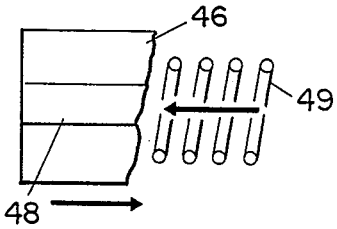
FIG. 2 is a diagrammatic view of the magnetic bolt of the present invention.
Figure 4:
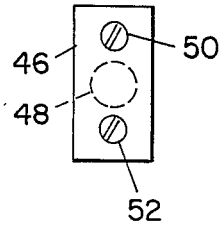
FIG. 4 is a diagrammatic view of the adjustable magnetic bolt of this invention.

Referring now to FIG. 2 there is shown the internal magnet assembly of the present invention. The internal magnet assembly comprises a magnet housing 46 and an internal bar magnet 48. A spring 49 is provided which holds the internal bar magnet and magnet housing against the face plate 28, unless it is retracted by use of the knob, lever or exit device, or the key in cylinder 14.

The retraction of the latch bolt 18 and the internal bar magnet 48 is accomplished by turning the knob, lever, or pushing an exit device. The manner in which this is accomplished is a variety of quite standard mechanical linkages such as the simultaneous retraction of the dead bolt and latch bolt on standard mortise and cylindrical/-dead bolt combination locks. When retracted by any of these methods, the circuit formed by the bar being in the proximity of the magnetic switch 44 is then broken.

Figure 3:
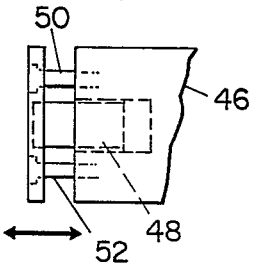
FIG. 3 is a diagrammatic view of the adjustable magnetic bolt.

Referring now to FIG. 3 there is shown an internal magnet assembly comprising the magnet housing 46 and the internal bar magnet 48 which is now adjustable by adjustment screws 50 and 52. This adjustment is provided if desired by the builder in order that the strength of the magnetic contact between the internal bar magnet 48 and the magnetic switch 44 can be adjusted.

Figure 5:
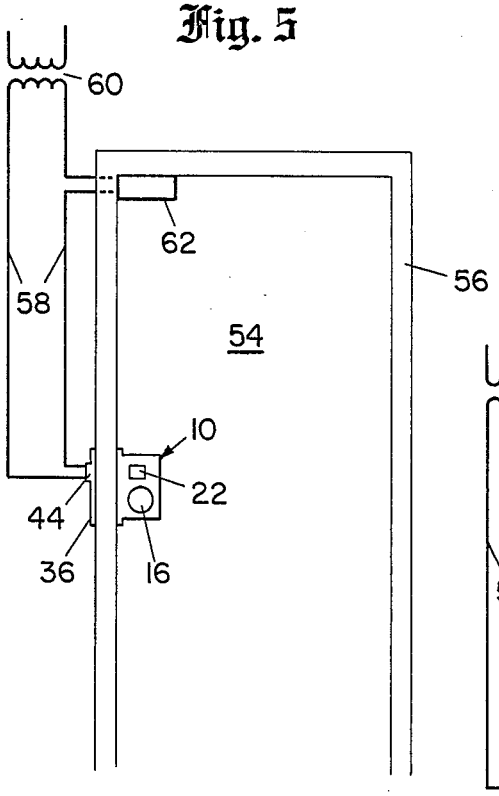
FIG. 5 is a diagrammatic view of the door containing the system of the present invention from the inside.
Figure 7:
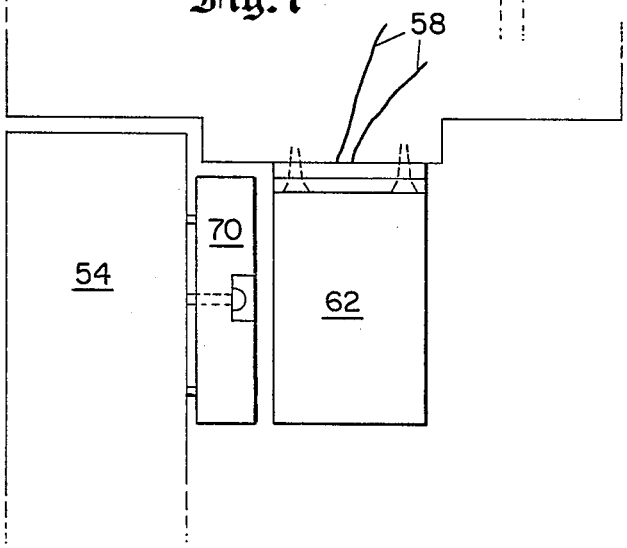
FIG. 7 is a diagrammatic view of the magnetic lock of the present invention installed on a door.

Referring now to FIG. 5 there is shown a diagram of a door 54 and a door jamb 56. FIG. 5 shows the lock of the present invention from the inside or push side of the door. There is shown a lock 10 with a knob 16 and the internal magnet is shown 22. On the door jamb is the lock strike 36 and a magnetic switch 44. Wires 58 run the power from a power source 60 to the magnetic switch 44. The magnetic lock 62 along with an armature shown in FIG. 7 provides the locking device for the door 54. Other electrically activated locks may be utilized.

Figure 6:
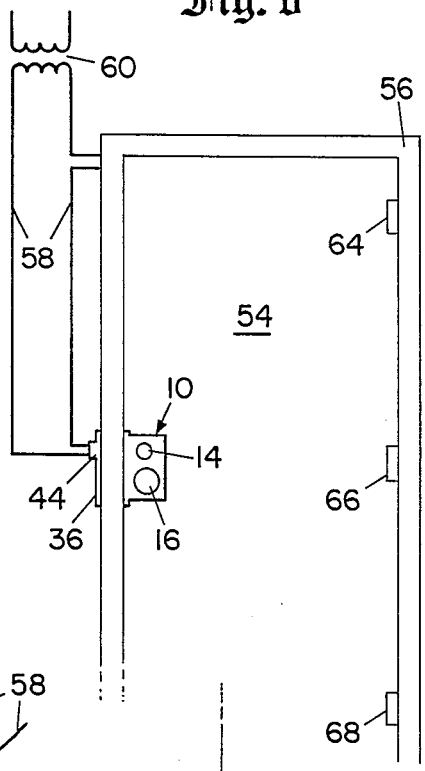
FIG. 6 is a diagrammatic view of the door containing the lock of this invention from the outside.

Referring now to FIG. 6 there is shown the door 54 in the door jamb 56 from the outside or pull side of the door 54. The door 54 is attached to the frame 56 by hinges 64, 66 and 68. The lock 10 is shown with cylinder 14 and knob 16. On the door jamb is lock strike 36 with magnetic switch 44 connected by wires 58 to power source 60.

Referring now to FIG. 7 there is a side view of the door 54 to which is connected an armature 70. Wires 58 leading from power source 60 through the magnetic switch 44 which energize the magnetic lock 62 which is fixedly attached to the door frame. Thus, when the circuit is closed by the connection of the magnetic switch and the internal bar magnet, the door is securely held closed by the action of magnetic lock 62 and armature 70.

Figure 8:
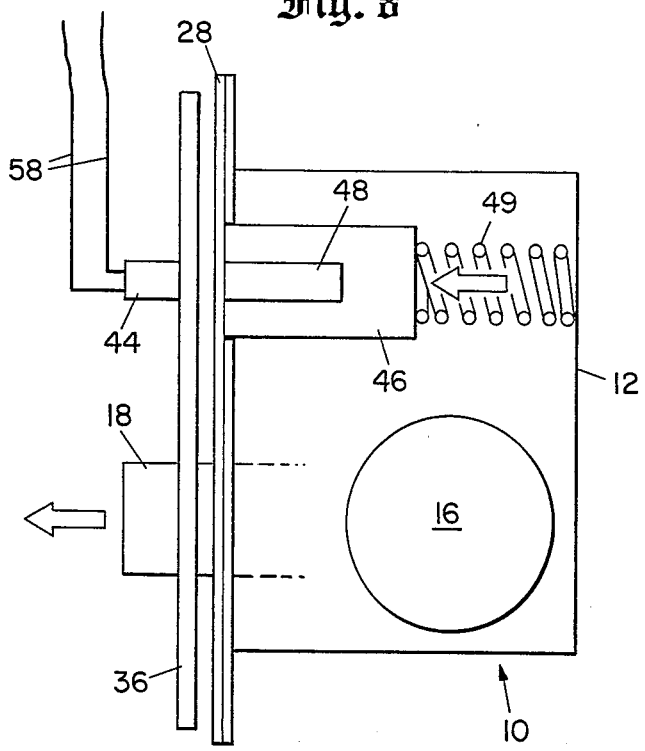
FIG. 8 is a mechanical diagram of a construction of the lock of the present invention in a closed and locked position.

Referring now to FIG. 8, there is shown an internal view of the lock 10 in a closed and locked position. There is shown the knob 16, the lock housing 12, and the spring 49, which holds the magnetic housing 46 and the bar magnet 48 against the face plate 28. The latch bolt 18 is extended through the latch strike 36, thus latching the door. The magnetic switch 44 with connecting wires 58 is activated when the internal bar magnet 48 is against the front of face plate 28, thus locking the door.

Figure 9:
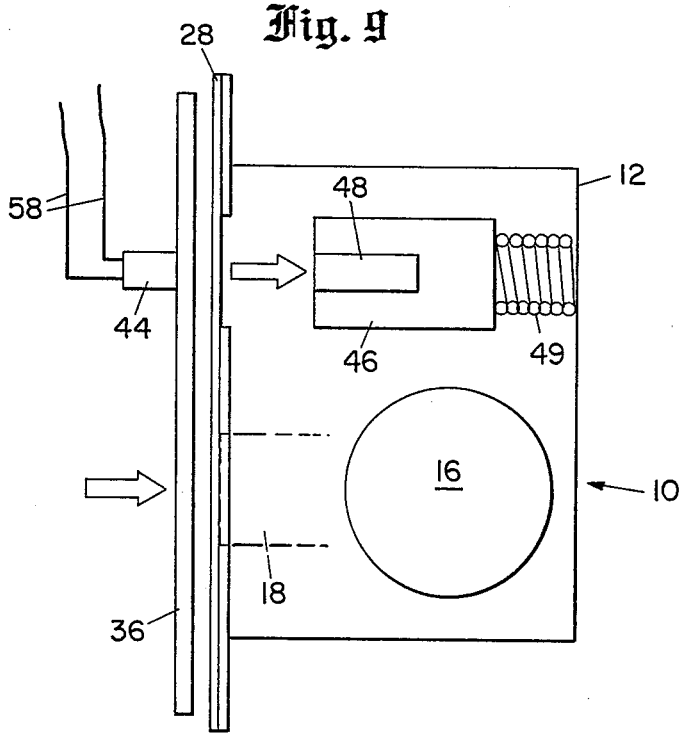
FIG. 9 is a mechanical diagram of the lock of the present invention in an opened and unlocked position.

Refering now to FIG. 9. there is shown an internal view of the lock of the present invention, in an opened and unlocked position. There is shown a lock 10 with knob 16 in which latch bolt 18 has been retracted by action of, for instance, the knob 16. Action of knob 16 retracts internal magnet 48 in magnet housing 46, compressing spring 49. This removes the internal magnet 48 from the face plate 28 and from proximity with magnetic switch 44.

When a key is placed into the cylinder 14 from the outside and turned, the latch bolt 18 is retracted and the internal magnet is removed from proximity of the magnetic switch and the power is cut off from the magnetic lock, thus unlocking the door at 62. The magnet is automatically returned to its original position when the knob or key is released. Thus, when the door closes, the magnetic lock is automatically energized. The system is totally failsafe because if the power is cut in any way in an emergency, the magnetic lock will release since without power it cannot operate. Thus, the system can be tied into the fire alarm systems in the building or to a central control so that by the use of a central control or when the fire alarm is activated, all power to the door can be withdrawn thus unlocking it.

The failsafe security lock does not require any special door preparation, or electrical modification to the door. Some existing locks can be modified to accept the failsafe security lock. All power used is low voltage and in the door jamb not in the door. Even the installation of the bar magnet itself is not acutely critical since the bar magnet in the lock only has to be in the proximity of the magnetic switch to close the circuit. In this way a securely locked door is provided and also one that meets all requirements of normal fire regulations.

All modifications and changes of an obvious nature to those skilled in the art are deemed to fall within the spirit and scope of this invention is represented by the appended claims.

I claim:

1. A safety door lock for a door comprising an electromagnetic lock, a magnetic switch located opposite an internal magnet mounted in a lock housing, the magnetic switch and internal magnet forming a closed circuit with the electromagnetic lock, means located in the lock housing to retract the internal magnet from the magnetic switch in order to break the close circuit.

2. The device of claim 1 wherein a spring biases the internal magnet in the direction of the magnetic switch.

3. The device of claim 2 wherein the means to retract the internal magnet comprises a member from the group consisting of a knob, lever, or exit device.

4. The device of claim 2 comprising means in the lock housing to adjust the proximity of the internal magnet relative to the magnetic switch.

5. A safety door lock for a door mounted in a door jamb, comprising an electromagnetic lock, a magnetic switch adapted to be mounted in or on a door jamb, the magnetic switch located opposite an internal magnet mounted in a lock housing, the magnetic switch and internal magnet forming a closed circuit with the electromagnetic lock, means located in the lock housing to retract the internal magnet from the magnetic switch in order to break the closed circuit.

6. The device of claim 5 comprising a source of electrical power to operate the magnetic switch.

7. The device of claim 5 comprising a spring adjacent to the internal magnet adapted to bias the internal magnet in the direction of the magnetic switch.

8. A magnetic safety door lock for a door in a door jamb having an electromagnetic lock comprising a lock housing in or on the door comprising a latch bolt, an internal magnet in the lock housing abutting a face plate covering said internal magnet, a lock strike in the door jamb, a latch bolt keeper in said lock strike, a magnetic switch located opposite the internal magnet abutting said lock strike, the magnetic switch and internal magnet forming a closed circuit with said electromagnetic lock, means in the lock housing to retract the internal magnet in order to break the circuit.

9. The device of claim 8 comprising a spring adjacent to the internal magnet adapted to bias the internal magnet in the direction of the face place.

10. The device of claim 8 comprising means in the lock housing to adjust the proximity of the internal magnet relative to the magnetic switch.

11. The device of claim 8 wherein the means to retract the internal magnet is a member from the group consisting of a key cylinder, knob, lever and exit device.

12. The device of claim 8 comprising a source of electrical power to operate the magnetic switch.

13. The device of claim 8 in which the electromagnetic (electrically activated) lock comprises a magnetic lock adapted to be fixedly attached to (the) a door jamb and an armature adapted to be fixedly attached to (the) a door.

14. The device of claim 10 wherein the means to adjust the internal magnet are adjustment screws located adjacent to the internal magnet.

15. The device of claim 8 in which the electromagneitc lock comprises a magnetic lock adapted to be fixedly attached to a door and an armature adapted to be fixedly attached to a door jamb.

* * * * *